US005722478A

United States Patent [19]

Claypool et al.

[11] Patent Number: 5,722,478

[45] Date of Patent: Mar. 3, 1998

[54] VENETIAN BLIND SAFETY PULL CORD ASSEMBLY

[76] Inventors: Jeff Claypool; Karyn Claypool, both of 7413 Westcliff Dr., West Hills, Calif. 91304

[21] Appl. No.: 710,905

[22] Filed: Sep. 24, 1996

Related U.S. Application Data

[63] Continuation-in-part of Ser. No. 511,671, Aug. 7, 1995, abandoned.

[51] Int. Cl.[6] ..... E06B 9/30

[52] U.S. Cl. ..... 160/173 R; 160/178.1 R

[58] Field of Search ..... 160/178.2 R, 173 R, 160/178.1 R, 168.1 R, 84.01, 84.04, 84.05, 340, 341, 344, 345, 320

[56] References Cited

U.S. PATENT DOCUMENTS

| | | | |
|---|---|---|---|
| 1,855,346 | 4/1932 | Forse | 160/166.1 R |
| 2,116,357 | 7/1938 | Laborda et al. . | |
| 2,410,549 | 11/1946 | Olson . | |
| 3,633,646 | 1/1972 | Zilven . | |
| 3,727,665 | 4/1973 | Debs . | |
| 4,759,398 | 7/1988 | Renée . | |
| 4,909,298 | 3/1990 | Langhart et al. . | |
| 5,058,650 | 10/1991 | Morris . | |
| 5,125,447 | 6/1992 | Suggs . | |
| 5,275,222 | 1/1994 | Jelic et al. | 160/178.2 R |
| 5,379,825 | 1/1995 | Jelic . | |
| 5,465,775 | 11/1995 | Biba et al. | 160/178.1 R X |
| 5,472,035 | 12/1995 | Biba et al. | 160/178.1 R X |
| 5,501,262 | 3/1996 | Inaba et al. | 160/178.2 R |
| 5,513,687 | 5/1996 | Tuzmen et al. | 160/168.1 R |
| 5,553,653 | 9/1996 | Rozon | 160/173 R |

*Primary Examiner*—David M. Purol

*Attorney, Agent, or Firm*—John J. Posta, Jr.

[57] ABSTRACT

The venetian blind pull cord assembly is a safety device to prevent exposure of the pull cords and inadvertant accidents to children, due to their attraction to pull cords. The assembly includes a) a preferably cylindrical upper housing connectable to an overhead venetian blind operating mechanism or the like and designed to depend therefrom. The assembly includes a preferably cylindrical housing connectable to an overhead venetian blind operating mechanism or the like by connectors and designed to depend therefrom; and b) a generally tubular pull cord cover having two or more vertically aligned telescoping portions of decreasing diameter, the cover telescoping fully into the lower end of the housing and depending therebelow. The cover is dimensioned so that when fully retracted it defines with the housing a pull cord storage space. The housing and cover have vertically aligned passageways down through which pull cords pass. The lower end of the cover includes a transverse pull handle to which the lower end of the pull cords connect. The handle can be frictionally engaged with a cover portion or the housing to decrease the effective length of the assembly.

9 Claims, 3 Drawing Sheets

24
26
74
76
14
20
12
22
18
18
34
36
32
28
16
38
46
30
10
48
50
60
52
44
62
30
54
40
58
66
64
56
70
72
68
74a
74b
80
82
80
82
110
38c
114
10b
116
118
40c
40a
58a
70a
72a

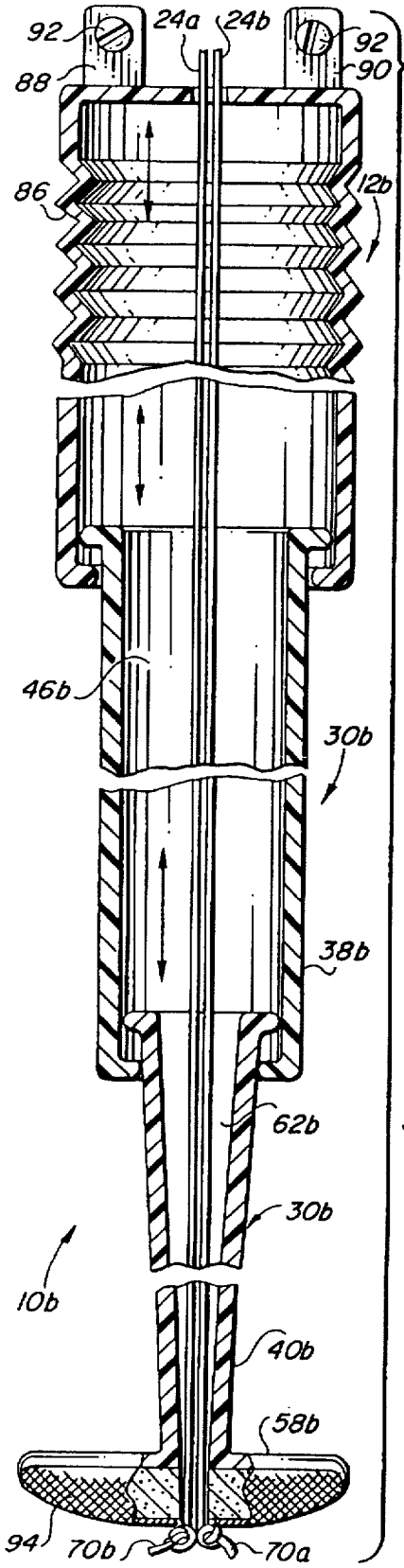
FIG. 3
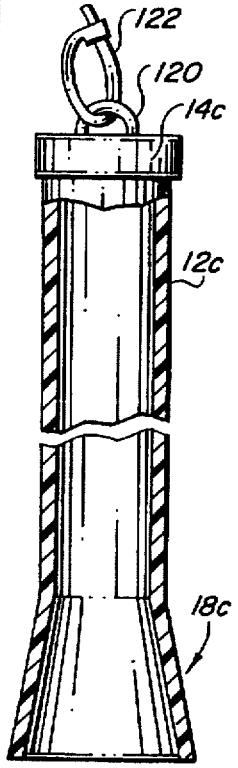
FIG. 6
FIG. 4
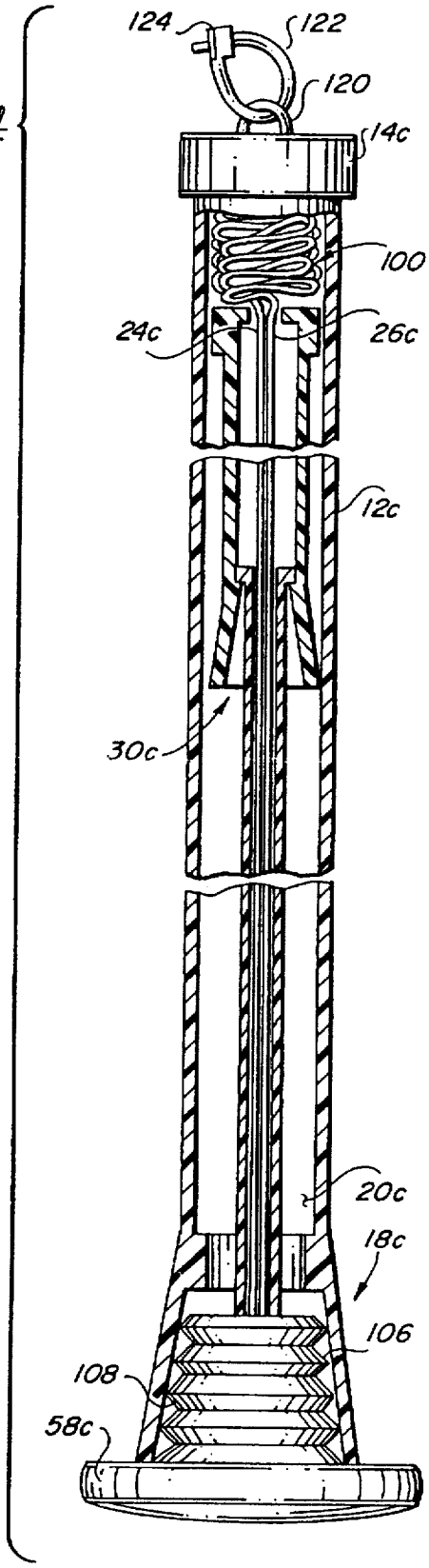

VENETIAN BLIND SAFETY PULL CORD ASSEMBLY

This is a continuation-in-part of U.S. patent application Ser. No. 08/511,671, filed Aug. 7, 1995 now abandoned.

BACKGROUND OF THE INVENTION

1. Field of the Invention

The present invention generally relates to safety devices and more particularly to an improved venetian blind pull cord safety device.

2. Prior Art

Venetian blinds characteristically have pull cords which dangle down at the sides of the blinds and in most cases are easily reached by young children. Such children frequently are fascinated by the way in which the cords sway about, particularly when they have weight pulls connected to their lower ends.

Such cords are a distinct hazard to the child. Not only can the child become sick or choke on the cord ends or the cord weights, but when a child plays with the cords there is a danger he or she can become entangled in the cords and be strangled by them.

One way of removing the danger of dangling pull cords is to connect a hook or the like to the blind valance at the top of the blind array and loop the cords over the hook and thus out of the reach of the child. However, this is a nuisance. The cords when looped up in this manner may even be hard to reach by an adult and can become entangled with each other. Moreover, the looped cords are an eyesore, as is the cord hook. Accordingly, few venetian blind assemblies include such cord hooks, and instead leave the pull cords in a fully exposed dangerous position easily accessible to the child at the side of the venetian blind assembly.

One attempt to solve this problem is shown in U.S. Pat. No. 5,125,447 to Suggs. This patent discloses a safety device for window decoration cords. The safety device is a plate to be mounted on a wall near the window. The pull cords or decorative cords are connected to the rear plate, specifically to wheels or pulleys, in turn connected to levers extending from the rear of the plate out through openings in the front of the plate.

This device has several disadvantages. In the first place, it requires a special alignment of the cord array used in the venetian blind assembly or the like. Secondly, it is difficult to install. Moreover, it is limited to positioning on a wall where it is easily seen. Moreover, it is expensive and can easily become misaligned and inoperative.

Accordingly, there remains a need for a simple, inexpensive, durable and efficient device for protecting venetian blind pull cords and the like front access by a child and thus preventing mishaps such as those described above. Such device should be easy to install and be unobtrusive in appearance. Moreover, it should not be limited as to the location where it can be used.

SUMMARY OF THE INVENTION

The improved venetian blind safety pull cord assembly of the present invention satisfies all the foregoing needs. The assembly is simple, durable, affordable, unobtrusive, utilizable with a wide array of venetian blind and similar assemblies, is efficient.and fully protects pull cords from access by a child. It can be installed by anyone without special tools.

The improved assembly of the present invention is substantially as set forth in the ABSTRACT OF THE DISCLO- SURE. Thus, the assembly comprises a housing defining a generally central space. The housing includes connector means for suspending the housing from the underside of an overhead blind mechanism-containing valance or the like. A cover for venetian blind pull cords is connected to the lower portion of the housing, telescopes fully thereinto and depends therefrom. The cover defines with the interior of the housing a pull cord storage space above the cover when the cover is fully retracted.

Preferably, the cover has two or more telescoping vertically aligned portions of decreasing diameter and includes a bottom transverse expanded pull handle. A pull cord passageway extends vertically throughout the length of the assembly, that is, through the upper housing and lower cover and the lower ends of pull cords are connectable to the handle for easy access for replacement.

Thus, pull cords, when the present assembly is used, are fully sheathed throughout their length, whether they are in the extended, that is "down" position or in the shortened "up" position, since the cover automatically moves with them, telescopically lengthening or shortening, as needed. The pull handle connected to the cover, and preferably integral therewith, is used to pull the pull cords down. Moreover, the housing and cover can be swung easily sideways to lock the pull cords in the desired position and thus control the heighth of the lifted portion of the venetian blinds.

In one embodiment, the assembly of the present invention includes an accordion pleated section in the housing and/or cover so that the housing and/or cover can be increased in effective length, if desired. In another embodiment, the handle has an exterior surface which can be saturated with a bitter tasting but harmless liquid such as bittle apple extract to prevent a child from chewing on the handle. Preferably, the housing and cover are fabricated of transparent rigid plastic so as to be unobtrusive in appearance.

The handle includes an upper extension frictionally engageable with the lower end of the housing and/or the lower end of the uppermost portion in order to hold the handle up and out of the way.

Further features of the improved assembly of the present invention are set forth in the following detailed description and accompanying drawings.

DRAWINGS

FIG. 3 is a schematic front elevation of a third preferred embodiment of the improved venetian blind safety pull cord assembly of the present invention, showing the assembly as transparent except for the absorbent pad connected to the pull handle, and with a pleated section in the housing thereof;

FIG. 4 is a schematic front elevation of a fourth preferred embodiment of the improved assembly of the present invention, the assembly being transparent, and being shown with the cover fully retracted within the housing and the pull handle frictionally engaged with the housing;

FIG. 6 is an enlarged schematic fragmentary front elevation of the upper and lower ends of the housing of FIG. 4;

DETAILED DESCRIPTION

FIG. 1.

Figures 1, 2, 7, 8:
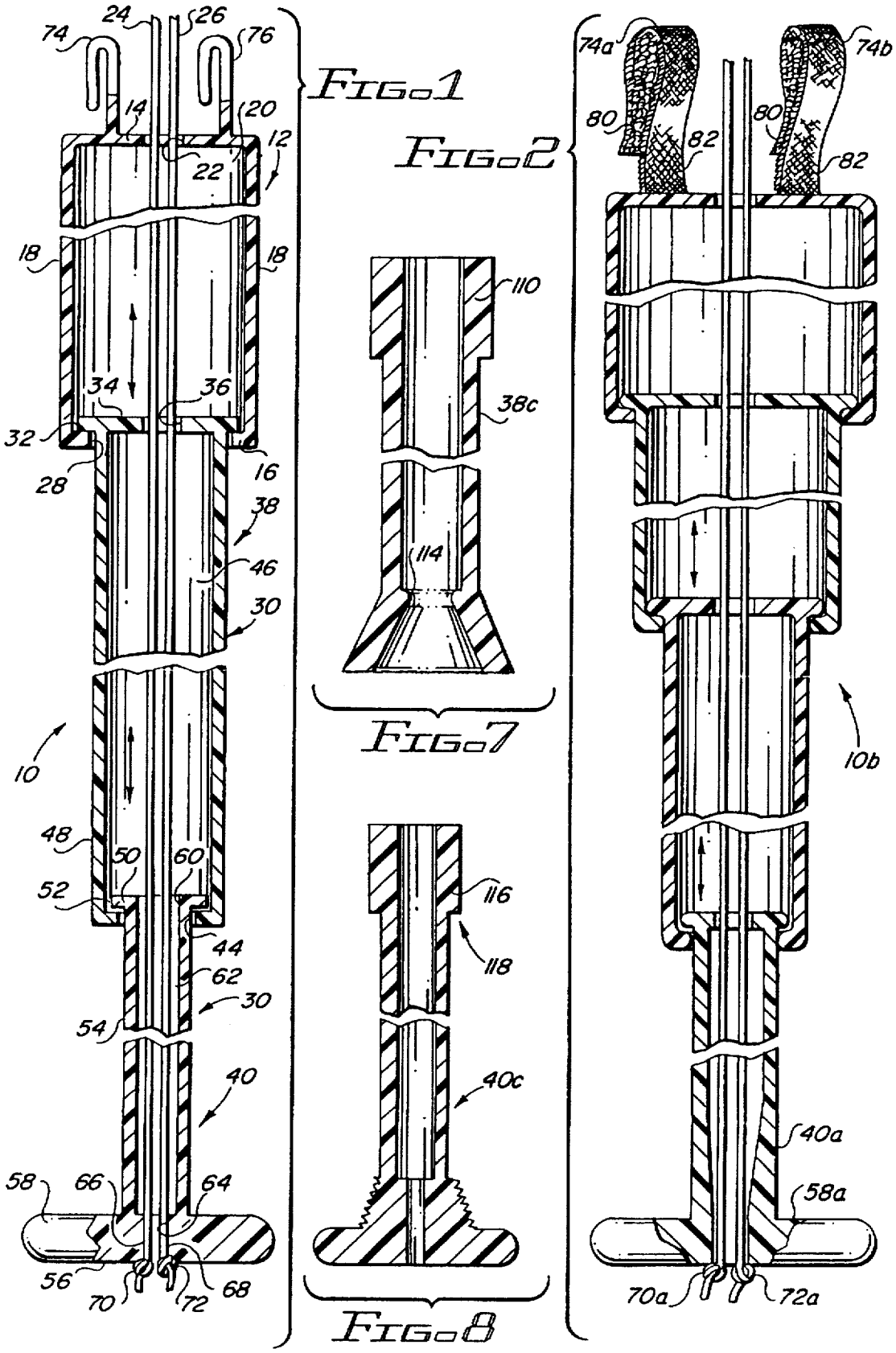
FIG. 1 is a schematic front elevation, partly broken away, of a first preferred embodiment of the improved venetian blind safety pull cord assembly of the present invention, showing the assembly as transparent and with a pair of pull cords installed therein.
FIG. 2 is a schematic front elevation, partly broken away, of a second preferred embodiment of the improved venetian blind safety pull cord assembly of the present invention, showing the assembly as transparent and with a pair of pull cords installed therein.
FIG. 7 is an enlarged schematic fragmentary front elevation of the upper and lower ends of the upper portion of the cover of FIG. 4.
FIG. 8 is an enlarged schematic fragmentary front elevation of the upper and lower ends of the lower portion of the cover of FIG. 4, including the handle thereof.
Figure 5:
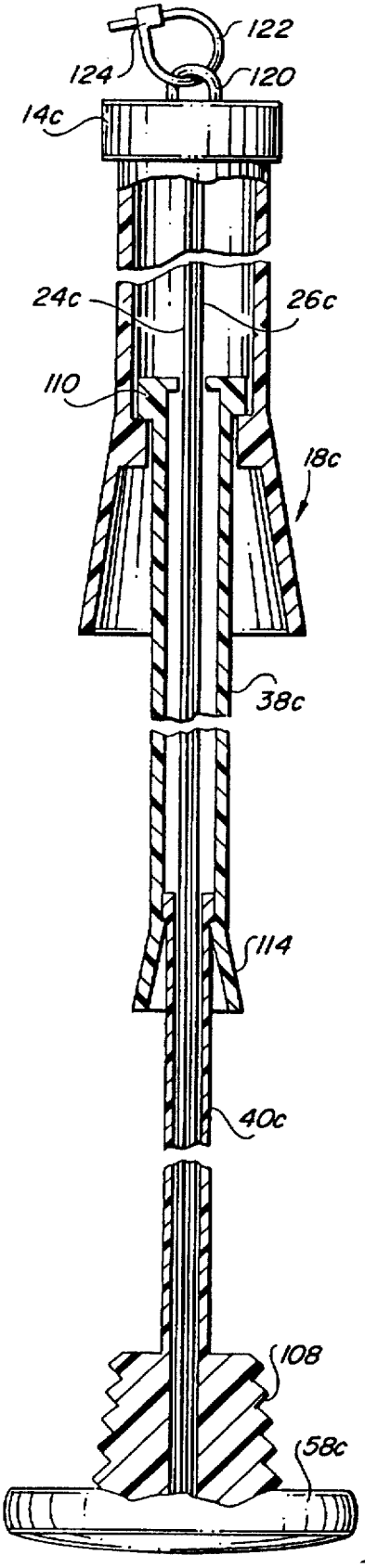
FIG. 5 is a fragmentary schematic front elevation of the assembly of FIG. 4, shown in the fully extended position.
Figure 9:
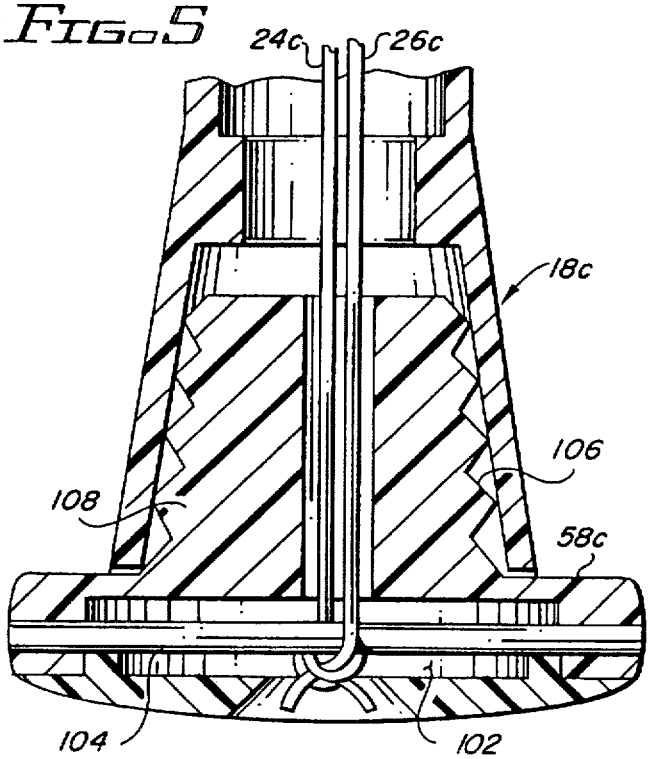
FIG. 9 is an enlarged schematic front elevation of the handle of FIG. 4, shown engaged with the lower end of the housing of FIG. 4; and, FIG. 10 is an enlarged fragmentary schematic front elevation of the upper end of the lowermost portion of the cover of FIG. 4 engaged with the lower end of the upper portion of the cover of FIG. 4.
Figure 10:
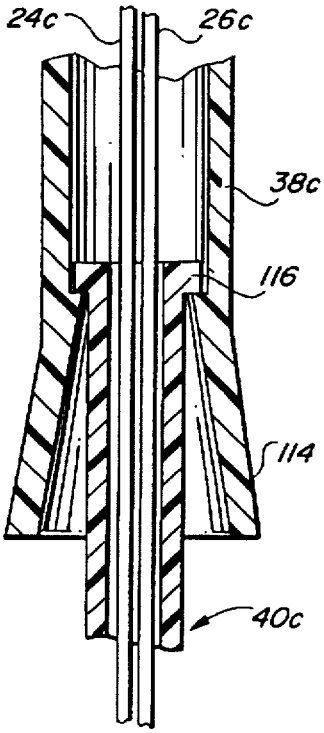

A first preferred embodiment of the improved venetian blind safety pull cord assembly of the present invention is schematically depicted in FIG. 1. Thus, assembly 10 is shown, which includes a housing 12 having a horizontal upper end wall 14, a horizontal bottom wall 16 and vertical sides 18 interconnecting walls 14 and 16 to define therewith a generally central cavity 20. Preferably, housing 12 is cylindrical, or oval, but may be square, rectangular or another shape in plan view.

Wall 14 defines an opening 22 aligned along the vertical longitudinal axis of assembly 10 and extending down through wall 16. Opening 22 permits the passage down therethrough of a pair of venetian blind pull cords 24 and 26. Bottom wall 16 defines a larger opening 28 also aligned along the vertical longitudinal axis of assembly 10 and adapted to receive a pull cord cover 30 forming part of assembly 10.

Cover 30 is preferably cylindrical and has a peripheral flange 32 intergral with the horizontal upper wall 34 thereof. Flange 32 prevents removal of cover 30 from cavity 20.

Wall 34 has an opening 36 therein extending down therethrough and aligned along said longitudinal axis of assembly 10.

Cover 30 has two portions, an upper portion 38 and a lower portion 40. Wall 34 forms the upper end of portion 38 while horizontal wall 42 forms the bottom of portion 38 and defines a large opening 44 within which lower portion 40 is received into a cavity 46 defined by walls 34 and 42 and interconnecting sides 48.

Lower portion 40 has an upper horizontal wall 50 bearing a peripheral flange 52 which prevents removal of portion 40 from portion 38. Portions 38 and 40 are preferably cylindrical. Portion 40 has a vertical annular sidewall 54 which runs down to the lower end of cover 30 and terminates in a bottom wall 56 having a peripheral handle 58.

Upper wall 50 of lower portion 40 defines a central opening 60 extending down therethrough along the longitudinal axis of assembly 10 and communicating with a central cavity 62. Cavity 62 also communicates with a narrow central vertical opening 64 extending down through bottom wall 56 to the bottom of assembly 10.

As shown in FIG. 1, cords 24 and 26 pass down along the longitudinal axis of assembly 10 throughout the entire length thereof and the lower ends 66 and 68 of cords 24 and 26, respectively, are tied off into knots 70 and 72, respectively, which are too large in diameter to pass up through narrow central opening 64. Therefore, assembly 10 is thereby fixed in place over and fully covers cords 24 and 26 so that they cannot be chewed, swallowed or played with by a child.

Lower portion 40 of cover 30 is dimensioned to telescope up and down in upper portion 38 of cover 30, while upper portion 38 of cover 30 is dimensioned to telescope up and down in housing 12.

Assembly 10 can be held in place to depend from an overhead venetian blind assembly (not shown) by a spaced pair of upstanding hooks 74 and 76 secured to wall 14 and adapted to be connected to such overhead assembly.

With this arrangement, when handle 58 is pulled down, cords 24 and 26 are simultaneously pulled down to pull up venetian blinds to which they are attached. Such blinds can then be locked in place by swinging assembly 10 sideways in a given direction to activate a locking mechanism in the overhead venetian blind assembly. When such locking mechanism is released by swinging assembly 10 in the opposite direction, the weight of the raised venetian blinds descending raises cords 24 and 26 and automatically carries with it the telescoping portions of assembly 10. Thus, portion 40 telescopes into portion 38 and portion 38 telescopes into housing 12, driven upward by cords 24 and 36 connected to assembly through knots 70 and 72. Preferably, housing 12 and cover 30 are of transparent durable rigid material such as plastic or the like so that they are visually unobtrusive. Assembly 10 can be made in any suitable shape and length to suit the requirements of the venetian blind assembly to which assembly 10 is to be connected. It will be understood that assembly 10 is equally useful with pull cord-bearing devices and assemblies generally similar to but not classifiable as venetian blind assemblies.

FIG. 2.

A second preferred embodiment of the improved assembly of the present invention is schematically depicted in FIG. 2. Thus, assembly **10*a* is shown. Components thereof similar to those of assembly 10** bear the same numerals but are succeeded by the letter "a".

Assembly **10*a* is substantially identical to assembly 10** except as follows:

a) Connectors **74*a* and 76*a* are in the form of open loops bearing hooks 80 at one end thereof and hook-receiving loops 82** at the opposite end thereof.

b) In addition to portions **38*a* and 40*a*, cover 30*a* has an intermediate portion 84 substantially identical to portion 38*a* but of smaller dimensions and interconnecting portions 38*a* and 40*a*** in telescoping relation.

c) Portion **40*a* has a gradually narrowing central cavity 62*a*** in the lower part thereof.

Assembly **10*a* has substantially the advantages of assembly 10**.

FIG. 3.

A third preferred embodiment of the improved assembly of the present invention is schematically depicted in FIG. 3. Thus, assembly **10*b* is shown. Components thereof similar to those of assembly 10** bear the same numerals but are succeeded by the letter "b".

Assembly **10*b* differs from assembly 10** only as follows:

a) Housing **12*b* has a horizontally extending vertically expandable pleated portion 86 to increase the effective length of housing 12*b*. Portion 86** preferably is formed of flexible resilient clear plastic material.

b) Instead of connector hooks, assembly **10*b* has a pair of vertical plates 88 and 90 securable to an overhead venetian blind assembly by screws 92**.

c) Portion 40b has an inverted cone shape with handle 58b bearing a liquid absorptive outer layer 94 of cloth mesh or the like so that layer 94 can be saturated, if desired, with a bitter tasting harmless liquid which can dry in place on layer 94 and discourage chewing of handle 58b by a child. Such a liquid can be, for example, an extract of bitter apple. Layer 94 can be of transparent plastic mesh woven cloth or the like, if desired.

Assembly 10b has the other advantages of assembly 10. FIGS. 4–10.

A fourth preferred embodiment of the improved assembly of the present invention is schematically depicted in FIGS. 4–10. Thus, assembly 10c is shown. Components thereof similar to those of assemblies 10, 10a and/or 10b bear the same numerals but are succeeded by the letter "c".

Assembly 10c differs from assembly 10 only as follows:

a) Housing 12c is dimensioned with respect to cover 30c so that when cover 30c is fully retracted within housing 12c, with handle 58c being the only portion of cover 30c extending out of housing 12c, a space 100 comprising the upper portion of cavity 20cis present to serve as a storage space for pull cords 24c and 26c;

b) Handle 58c has a hollow open bottom portion 102 having a transverse retaining bar 104 around which the lower ends of pull cords 24c and 26c are releasably cinched for easy access by the user to repair or replace;

c) The lower ends of vertical sides 18c of housing 12c are flared outwardly to frictionally releasably engage a corrugated outer surface 106 of a central upwardly projecting tubular extension 108 of handle 58c to releasably hold it in the retracted position, when desired. The lower end of upper portion 38c of cover 30c may also be flared outwardly for releasable engagement with surface 106 of handle 58c;

d) The upper end 109 of portion 38c has an external sleeve 110 which prevents its removal from housing 12c while the lower end 112 of portion 38c has a pinched in area 114 which prevents removal of portion 40c therefrom, because of an external sleeve 116 on the upper end 118 of portion 40c; and, e) Top end wall 14c of housing 12c has a ring 120 through which a flexible resilient openable loop 122 is passed, loop bearing a releasable connector 124 for releasably securing assembly 10c to a venetian blind structure.

Assembly 10c has the other advantages of assemblies 10, 10a and 10b.

Various other modifications, changes, alterations and additions can be made in the improved assembly of the present invention, its components and their parameters. All such modifications, changes, alterations and additions as are within the scope of the appended claims form part of the present invention.

What is claimed is:

1. An improved venetian blind safety pull cord assembly, said assembly comprising, in combination:

a) a housing having an upper end, a bottom end and upstanding sides interconnecting said upper end and said bottom end and collectively defining therewith a generally central cavity, said upper end and said bottom end each having a generally central opening extending down therethrough and into communication with said cavity, said housing openings being vertically aligned with each other and adapted to receive venetian bind pull cords;

b) connector means connected to said housing and extending upwardly therefrom for releasably connecting said housing in depending relation to an overhead venetian blind operating structure; and, c) a generally tubular venetian blind pull cord cover telescopingly received within said housing through said housing bottom end, said cover comprising a plurality of interconnected portions, said portions decreasing in diameter from the uppermost of said portions to the lowermost of said portions, and telescoping within each other, said portions having upper and lower aligned venetian blind pull cord-receiving openings, said cover extending below said housing and movable between an upper collapsed position in said housing and a lower telescoped extended position, said lowermost portion having a transversely extending expanded handle anchoring the lower ends of venetian blind pull cords thereto, whereby when said cords are pulled down, said cover automatically travels therewith to said extended position to protect the cords against exposure and inadvertant entangling of a child and when said cords travel up during operation of a venetian blind mechanism to which said cords are attached, said cover is automatically moved to said collapsed position.

2. The improved venetian blind safety pull cord assembly of claim 1 wherein said handle includes a fluid absorbing layer for impregnation of said handle with a child chewing detering fluid.

3. The improved venetian blind safety pull cord assembly of claim 2 wherein said cover comprises at least two cylinders telescoped together, said cylinders defining vertically aligned pull cord passageways therethrough.

4. The improved venetian blind safety pull cord assembly of claim 3 wherein said housing is generally cylindrical.

5. The improved venetian blind safety pull cord assembly of claim 1 wherein said housing includes a portion which is accordion folded for expanding and contracting the effective length of said housing.

6. An improved venetian blind safety pull cord assembly, said assembly comprising, in combination:

a) a housing having a closed upper end, an open bottom end and upstanding sides interconnecting said upper end and said bottom end and collectively defining therewith a generally central cavity communicating with said bottom end, said upper end having a generally central opening adapted to receive therethrough venetian blind pull cords;

b) connector means connected to said upper end of said housing for releasably connecting said housing in depending relation to an overhead venetian blind operating structure; and, c) a generally tubular venetian blind pull cord cover comprising a plurality of hollow, pull cord-receiving portions telescoped together and dimensioned to be fully retractable into said cavity in said housing and to extend therebelow, said portions when fully retracted defining with said housing a pull cord storage space above said portions in said housing, the lowermost of said cover portions having a generally horizontally extending expanded pull handle at the bottom end thereof, said handle including an upper centrally disposed tubular extension dimensioned to be releasably frictionally secured to one of a) the lower end of said housing, and b) the lower end of the uppermost of said cover portions when said cover is fully retracted.

7. The improved venetian blind pull cord safety assembly of claim 6 wherein the outer surface of said handle tubular extension is corrugated and wherein the lower end of said housing is outwardly flared to frictionally releasably engage said corrugated outer surface.

8. The improved venetian blind pull cord safety assembly of claim 6 wherein the underside of said pull handle includes a connector releasably securing the bottom end of said pull cords for easy access.

9. The improved venetian blind pull cord safety assembly of claim 6 wherein the upper end of each of said tubular cover portions bears an external sleeve and wherein the lower end of the internal surfaces of said housing and said cover portions other than said lowermost cover portion have inwardly directed detents engageable with said sleeves to prevent total separation of said telescoped portions from each other and said cover from said housing.

* * * * *